United States Patent [19]

Kozak

[11] Patent Number: 4,635,315

[45] Date of Patent: Jan. 13, 1987

[54] UPRIGHT CONVERTER FOR PORTABLE VACUUM

[76] Inventor: Burton Kozak, 551 Clavey La., Highland Park, Ill. 60035

[21] Appl. No.: 759,414

[22] Filed: Jul. 26, 1985

[51] Int. Cl.[4] ..... A47L 9/00

[52] U.S. Cl. ..... 15/329; 15/344; 15/350; 15/410

[58] Field of Search ..... 15/329, 344, 350, 410

[56] References Cited

U.S. PATENT DOCUMENTS

| | | | |
|---|---|---|---|
| 1,728,021 | 9/1929 | Juteur | 15/329 |
| 1,806,177 | 5/1931 | Pardee | 15/329 |
| 2,230,077 | 1/1941 | Foss | 15/329 |
| 2,303,409 | 12/1942 | Taylor | 15/329 |
| 2,456,639 | 12/1948 | Lanter | 15/329 X |
| 2,598,499 | 5/1952 | Breuer et al. | 15/329 X |

*Primary Examiner*—Chris K. Moore

*Attorney, Agent, or Firm*—Wood, Dalton, Phillips, Mason & Rowe

[57] ABSTRACT

An upright converter for a portable hand-held vacuum having nozzle and handle portions. The upright converter includes an adapter cooperating with the nozzle portion of the vacuum in a position for operation thereof and an adapter cooperating with the handle portion of the vacuum at a location remote from the nozzle adapter where the nozzle adapter and the handle adapter are interconnected such that the vacuum is retained therebetween. In addition, the upright converter includes a handle extending to a position to be gripped by a user in upright vacuum fashion.

22 Claims, 10 Drawing Figures

UPRIGHT CONVERTER FOR PORTABLE VACUUM

FIELD OF THE INVENTION

This invention relates to a conversion device, and more specifically, to an upright converter for a portable hand-held vacuum.

BACKGROUND OF THE INVENTION

In recent years, there has been a profusion of appliances and tools that are portable in nature. These have included everything from power tools and flashlights to small appliances such as those typically used in and around the house. Among the most popular small appliances is the portable hand-held vacuum cleaner.

Typically, the portable hand-held vacuum cleaner is sold with a mounting bracket adapted to be secured to the wall near an electrical outlet. The mounting bracket usually includes an internal transformer adapted to be supplied with electricity from the outlet by means of an electrical cord and plug. Additionally, the portable hand-held vacuum cleaner includes a rechargeable battery pack automatically connected to the transformer whenever the vacuum cleaner is disposed on the mounting bracket during periods of non-use.

Based upon the experience of many consumers, portable hand-held vacuum cleaners are effective for many light cleaning tasks in and around the home. It has been found, however, that such vacuum cleaners are often less useful than intended because of an inherent characteristic, i.e. their portable hand-held nature. In particular, this characteristic makes it difficult for the consumer to use the portable hand-held vacuum cleaner for purposes of cleaning a floor.

Because of this shortcoming of such devices, it has remained to provide a means for increasing the versatility of portable hand-held vacuum cleaners. This is particularly desirable in view of the large number of such vacuum cleaners that have been sold and continue to be sold to the buying public. If it was possible to use such vacuum cleaners in either hand-held or upright fashion, a consumer would find them much more desirable.

The present invention is directed to overcoming the above-stated problems and accomplishing the stated objects.

SUMMARY OF THE INVENTION

It is the principal object of the present invention to provide a conversion device for a portable vacuum. More specifically, it is an object of the invention to provide an upright converter for a portable hand-held vacuum having nozzle and handle portions. It is likewise an object of the invention to provide a universal adapter in an upright converter for any portable vacuum.

An exemplary embodiment of the invention achieves the foregoing objects in an upright converter having a pair of adapters. One of the adapters cooperates with the nozzle portion of the vacuum in a position for operation thereof, and the other of the adapters cooperates with the handle portion of the vacuum at a location remote from the nozzle adapter. In addition, means are provided for interconnecting the nozzle adapter and the handle adapter such that the vacuum is retained therebetween.

In the exemplary embodiment, handle means extends from at least one of the nozzle and handle adapters to a position to be gripped by a user in upright vacuum fashion. The handle means preferably includes an elongated handle extending upwardly from the handle portion and, if desired, the handle means can be formed of multiple telescoping sections.

In a preferred embodiment, the nozzle adapter has an opening for receiving and orienting the nozzle portion of the vacuum in a position for optimum operation thereof. It is also advantageous for the nozzle adapter to have a vacuum chamber in communication with the opening and arranged for placement over a surface to be vacuumed. With this construction, a resilient collar may be provided in the opening for sealingly engaging the nozzle portion of the vacuum above the vacuum chamber in the nozzle adapter.

Additionally, the handle adapter preferably has a recess for receiving and containing the handle portion of the vacuum at the location remote from the nozzle adapter. More specifically, the handle adapter advantageously has a handle conforming chamber defined by the recess and designed for receiving the handle portion of any of a number of vacuums in telescoping fashion. In addition, the handle adapter preferably includes a handle receiving opening remote from the recess from which the handle means extends to the position to be gripped by the user in upright vacuum fashion.

Other objects and advantages will become apparent from the following specification taken in connection with the accompanying drawings.

DESCRIPTION OF THE PREFERRED EMBODIMENT

Figures 1, 2, 3, 4, 5, 6:
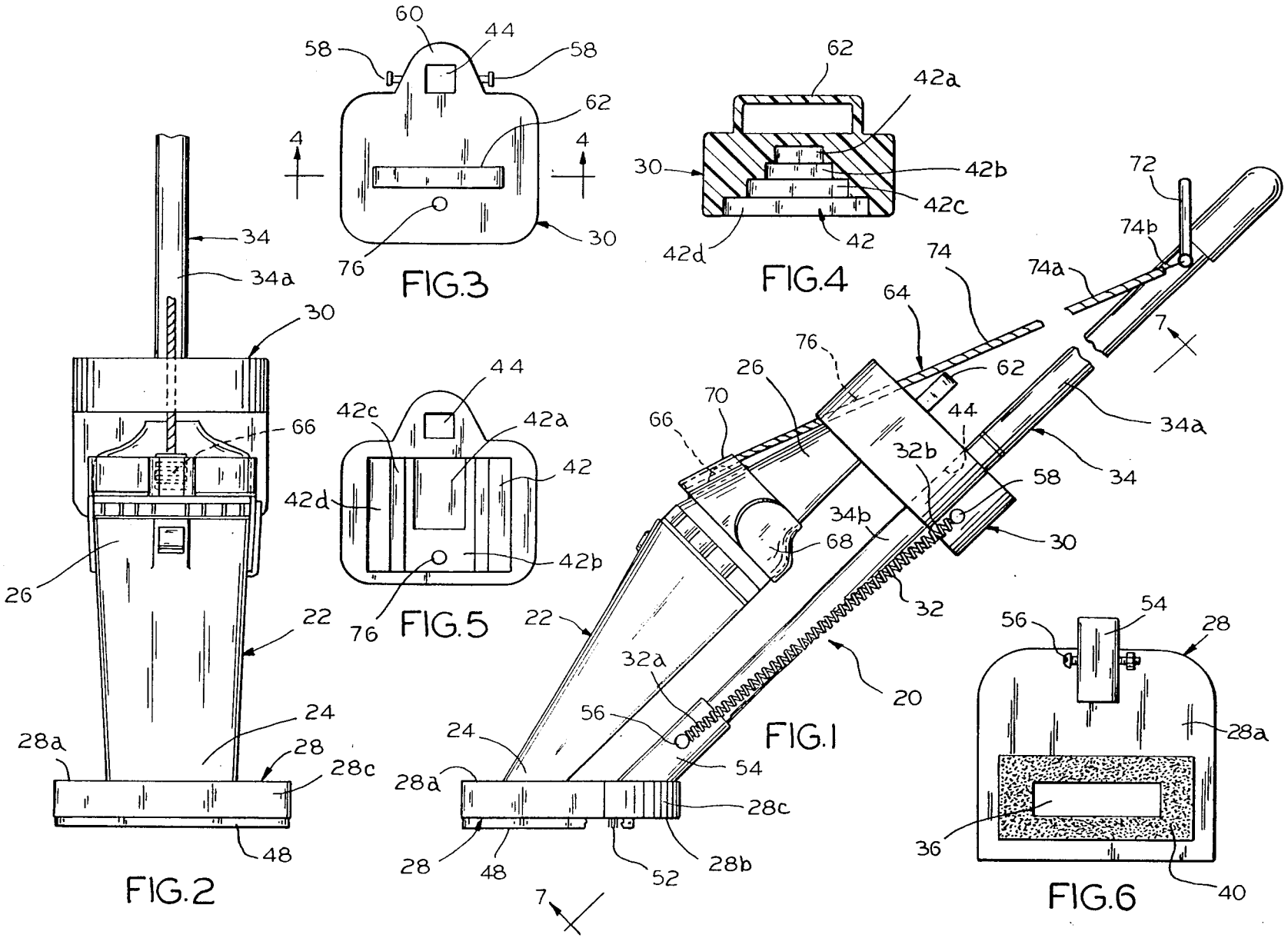
FIG. 1 is a side elevational view of an upright converter for a portable hand-held vacuum in accordance with the present invention.
FIG. 2 is a front elevational view of the upright converter in FIG. 1.
FIG. 3 is a top plan view of a handle adapter of the upright converter of FIG. 1.
FIG. 4 is a cross-sectional view of the handle adapter taken on the line 4—4 of FIG. 3.
FIG. 5 is a bottom plan view of the handle adapter of the upright converter of FIG. 1.
FIG. 6 is a top plan view of a nozzle adapter of the upright converter of FIG. 1.

An exemplary embodiment of an upright converter for a portable hand-held vacuum is illustrated in FIG. 1 in which the upright converter 20 is shown assembled with a portable hand-held vacuum 22 having a nozzle portion 24 and a handle portion 26. As shown, the upright converter 20 includes an adapter 28 cooperating with the nozzle portion 24 in a position for operation thereof and an adapter 30 cooperating with the handle portion 26 at a location remote from the nozzle adapter 28.

With the arrangement illustrated in FIG. 1, the upright converter 20 further includes means interconnecting the nozzle adapter 28 and the handle adapter 30 such that the vacuum 22 is retained therebetween. Specifically, the interconnecting means includes means associated with the nozzle adapter 28 and the handle adapter 30, such as the springs 32 (see also FIG. 7), for biasing the handle adapter 30 toward the nozzle adapter 28. As will be appreciated, the biasing force is sufficient to maintain the upright converter 20 in a position between the nozzle adapter 28 and the handle adapter 30 in fully assembled relation.

Still referring to FIG. 1, the upright converter 20 includes handle means extending from at least one of the nozzle and handle adapters 28 and 30, respectively, to a position to be gripped by a user in upright vacuum fashion. In particular, the handle means include an elongated handle 34 extending upwardly from the handle adapter 30 and, in the preferred embodiment, also extending downwardly to the nozzle adapter 28. Moreover, if desired, the elongated handle 34 may be made up of multiple handle sections 34*a* and 34*b*, for instance, to facilitate shipment and storage with easy assembly by the consumer in telescopic or locking collar fashion (see FIG. 8).

Referring to FIG. 6, the nozzle adapter 28 has an opening 36 for receiving and orienting the nozzle portion 24 of the vacuum 22 in a position for optimum operation thereof. It will also be appreciated by referring to FIG. 7 that the nozzle adapter 28 has a vacuum chamber 38 in communication with the opening 36 and arranged for placement over a surface such as a floor to be vacuumed. With this arrangement, a resilient collar 40 is provided in the opening 36 for sealingly engaging the nozzle portion 24 of the vacuum 22 above the vacuum chamber 38 in the nozzle adapter 28.

Referring to FIGS. 3–5, the handle adapter 30 has a recess 42 for receiving and containing the handle portion 26 of the vacuum 22 at the location remote from the nozzle adapter 28. Specifically, it will be appreciated that the recess 42 defines a handle conforming chamber of the handle adapter 30 designed for receiving the handle portion 26 of the vacuum 22 in telescoping fashion. In addition, the handle adapter 30 has a handle receiving opening 44 remote from the recess 42 through which the elongated handle 34 extends to the position to be gripped by the user in upright vacuum fashion.

Figure 7:
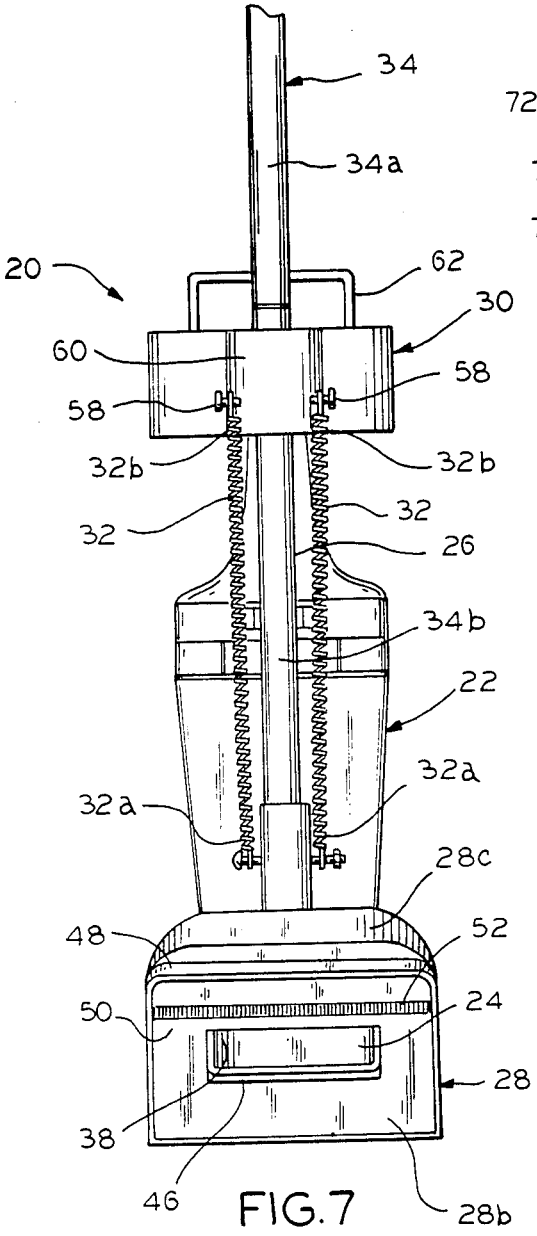
FIG. 7 is a rear elevational view of the upright converter taken on the line 7—7 of FIG. 1.

Once again referring to FIG. 6, the nozzle adapter 28 is preferably generally rectangular in shape and defined by a pair of generally parallel top and bottom surfaces 28*a* and 28*b* joined by a continuous side wall 28*c* (see also FIGS. 1 and 7). It will further be seen that the opening 36 is formed in the top surface 28*a* and the vacuum chamber 38 is formed between the top and bottom surfaces 28*a* and 28*b*. As will also be appreciated, the nozzle adapter 28 further includes a second opening 46 in the bottom surface 28*b* such that the nozzle portion 24 of the vacuum 22 is in communication with the surface to be vacuumed through the vacuum chamber 38.

As shown in FIG. 6, the resilient collar 40 in the opening 36 in the top surface 28*a* of the nozzle adapter 28 sealingly engages the nozzle portion 24 of the vacuum 22 above the vacuum chamber 38. It will also be seen that a continuous lip 48 extends downwardly from the bottom surface 28*b* of the nozzle adapter 28 to define a secondary vacuum chamber 50. Within the secondary vacuum chamber 50, a vacuum brush 52 is provided on the bottom surface 28*b* of the nozzle adapter 28 rearwardly of the second opening 46 to loosen dirt on the surface to be vacuumed.

Referring once again to FIGS. 4 and 5, the recess 42 in the handle adapter 30 preferably defines a handle conforming chamber having a plurality of multidimensioned chamber sections 42*a*, 42*b*, 42*c*, 42*d*. Each of the multi-dimensioned chamber sections 42*a*, 42*b*, 42*c*, 42*d* of the handle adapter 30 is adapted to receive the handle portion (such as 26) of at least one of a plurality of different commercially available portable hand-held vacuums (such as 22). Since there are a limited number of different portable hand-held vacuums in the marketplace, the handle adapter 30 can be formed so as to render the upright converter 20 to be essentially universal.

Referring to FIGS. 1, 6 and 7, the nozzle adapter 28 preferably includes a sleeve 54 extending toward the opening 44 in the handle adapter 30. It will be appreciated that the sleeve 54 and opening 44 are adapted to receive the elongated handle 34, substantially as shown, in telescopic fashion. With this arrangement, a bolt 56 or equivalent fastening means is provided for securing the elongated handle 34 in the sleeve 54 after assembly of the upright converter 20.

Referring to FIGS. 1, 3 and 7, the springs 32 extend between the nozzle adapter 28 and the handle adapter 30, as illustrated. It will be seen that the ends 32*a* of the springs 32 may be secured to the bolt or other fastening means 56 on or near the sleeve 54 of the nozzle adapter 28 and the opposite ends 32*b* of the springs 32 may be secured to axially aligned, spaced-apart studs 58 extending outwardly from a projection 60 of the handle adapter 30 containing the handle-receiving opening 44. With this arrangement, the springs 32 serve to bias the handle adapter 30 toward the nozzle adapter 28 for retaining the vacuum 22 therebetween.

Referring to FIGS. 1, 3 and 4, the handle adapter 30 includes a handle 62 opposite the recess 42. The handle 62 is provided for moving the handle adapter 30 against the biasing force of the spring 32 and away from the nozzle adapter 28. In this manner, the insertion and removal of the portable hand-held vacuum 22 from the upright converter 20 is easily accommodated.

Figure 8:
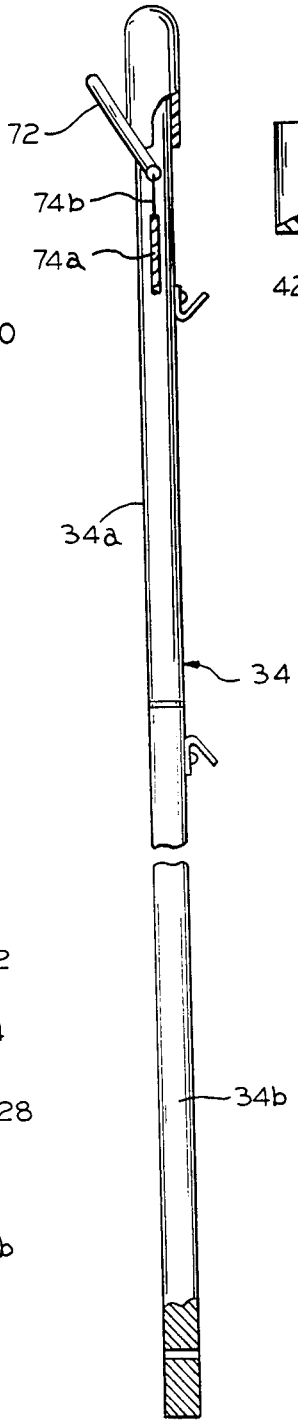
FIG. 8 is a side elevational view of handle means for the upright converter of FIG. 1.
Figure 10:
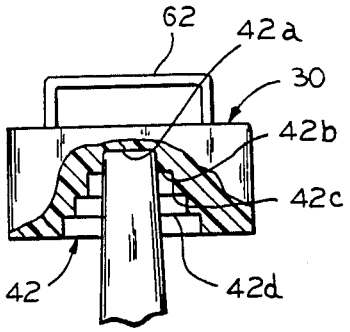
FIG. 10 is a partial front elevational view cut-away to illustrate the cooperation of the handle adapter with the handle portion of a portable hand-held vacuum.
Figure 9:
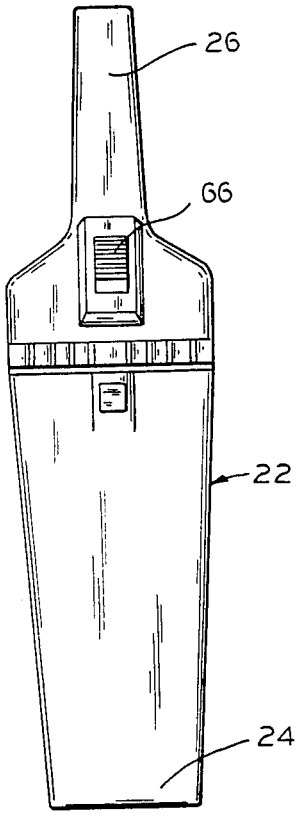
FIG. 9 is a front elevational view of a portable hand-held vacuum for use with the upright converter of FIG. 1.

As best shown in FIGS. 1, 2 and 8, the upright converter 20 also includes switch means 64 adapted to be operated remote from an on-off switch 66 of the portable vacuum 22. The switch means 64 includes a strap 68, preferably of Velcro adapted to be secured about the portable vacuum 22 to overlie the switch 66 and the strap 68 includes a movable slide member 70 engaging and operable to move the on-off switch 66 between the respective on and off positions. Additionally, the switch means 64 includes a switch handle 72 on the elongated handle 34 at the gripping position to be moved by swivel action between two positions.

More particularly, the switch handle 72 is operably interconnected to move the slide member 70 so as to move the on-off switch 66 between the respective on and off positions. In other words, one of the two positions of the switch handle 72 corresponds with the on position and the other of the two positions of the switch handle 72 corresponds with the off position of the on-off switch 66. Preferably, the switch handle 72 is in the position corresponding with the on position when swivelled to a position generally parallel to the elongated handle 34.

As shown, the switch handle 72 is joined to the movable slide member 70 by means of a shielded cable 74. The shielded cable 74 is comprised of an outer sheath 74*a* within which extends a wire cable 74*b* running from the movable slide member 70 to the switch handle 72. As shown, the shielded cable 74 passes through a small hole 76 in the handle adapter 30.

While in the foregoing there has been set forth a preferred embodiment of the invention, it is to be understood that the invention is only to be limited by the spirit and the scope of the appended claims.

I claim:

1. An upright converter for a portable hand-held vacuum having nozzle and handle portions, comprising:

an adapter cooperating with said nozzle portion of said vacuum in a position for operation thereof;

an adapter cooperating with said handle portion of said vacuum at a location remote from said nozzle adapter;

means interconnecting said nozzle adapter and said handle adapter such that said vacuum is retained between said nozzle adapter and said handle adapter; and handle means extending from at least one of said nozzle and handle adapters to a position to be gripped by a user in upright vacuum fashion.

2. The upright converter as defined by claim 1 wherein said nozzle adapter has an opening for receiving and orienting said nozzle portion of said vacuum in a position for optimum operation thereof.

3. The upright converter as defined by claim 2 wherein said nozzle adapter has a vacuum chamber in communication with said opening and arranged for placement over a surface to be vacuumed.

4. The upright converter as defined by claim 3 including a resilient collar in said opening for sealingly engaging said nozzle portion of said vacuum above said vacuum chamber in said nozzle adapter.

5. The upright converter as defined by claim 1 wherein said handle adapter has a recess for receiving and containing said handle portion of said vacuum at said location remote from said nozzle adapter.

6. The upright converter as defined by claim 5 wherein said handle adapter has a handle conforming chamber defined by said recess and designed for receiving said handle portion of said vacuum in telescoping fashion.

7. The upright converter as defined by claim 6 including a handle receiving opening remote from said recess in said handle adapter, said handle means extending from said handle receiving opening to said position to be gripped by said user in upright vacuum fashion.

8. The upright converter as defined by claim 1 wherein said interconnecting means includes means for biasing said handle adapter toward said nozzle adapter for retaining said vacuum therebetween.

9. The upright converter as defined by claim 1 wherein said handle means includes an elongated handle extending from said handle adapter to said position to be gripped by said user in upright vacuum fashion.

10. An upright converter for a portable hand-held vacuum having nozzle and handle portions, comprising:

an adapter having an opening for receiving and orienting said nozzle portion of said vacuum in a position for optimum operation thereof, said opening communicating with a vacuum chamber in said nozzle adapter arranged for placement over a surface to be vacuumed;

an adapter having a recess for receiving and containing said handle portion of said vacuum at a location remote from said nozzle adapter, said recess defining a handle conforming chamber in said handle adapter designed for receiving said handle portion of said vacuum in telescoping fashion;

means interconnecting said nozzle adapter and said handle adapter such that said vacuum is retained between said nozzle adapter and said handle adapter, said interconnecting means retaining said nozzle portion of said vacuum in said nozzle adapter opening, said interconnecting means retaining said handle portion of said vacuum in said handle adapter recess; and handle means extending from at least said handle adapter to a position to be gripped by a user in upright vacuum fashion.

11. The upright converter as defined by claim 10 wherein said nozzle adapter is generally rectangular in shape and defined by a pair of generally parallel top and bottom surfaces joined by a continuous side wall.

12. The upright converter as defined by claim 11 wherein said nozzle adapter opening is formed in said top surface and said vacuum chamber is formed between said top and bottom surfaces, said nozzle adapter also including a second opening in said bottom surface such that said vacuum chamber is in communication with said surface to be vacuumed.

13. The upright converter as defined by claim 12 including a resilient collar in said nozzle adapter opening for sealingly engaging said nozzle portion of said vacuum above said vacuum chamber.

14. The upright converter as defined by claim 12 including a vacuum brush on said bottom surface of said nozzle adapter, said vacuum brush being disposed rearwardly of said second opening in said nozzle adapter.

15. The upright converter as defined by claim 14 including a continuous lip extending downwardly from said bottom surface of said nozzle adapter to define a secondary vacuum chamber, said vacuum brush being disposed within said secondary vacuum chamber rearwardly of said second opening in said nozzle adapter.

16. The upright converter as defined by claim 10 wherein said recess in said handle adapter defines a handle conforming chamber having a plurality of multidimensioned chamber sections, each of said multidimensioned chamber sections of said handle adapter being adapted to receive said handle portion of at least one of a plurality of different portable hand-held vacuums.

17. The upright converter as defined by claim 10 wherein said nozzle adapter includes a sleeve extending toward an opening in said handle adapter, said sleeve and opening being adapted to receive said handle means, and including means for securing said handle means in said sleeve.

18. The upright converter as defined by claim 10 wherein said interconnecting means includes means associated with said handle adapter and said nozzle adapter for biasing said handle adapter towards said nozzle adapter for retaining said vacuum therebetween.

19. The upright converter as defined by claim 18 wherein said handle adapter includes a handle opposite said recess for moving said handle adapter against said biasing means away from said nozzle adapter to accommodate insertion and removal of said portable hand-held vacuum from said upright converter.

20. The upright converter as defined by claim 10 wherein said handle means includes an elongated handle extending from said nozzle adapter and through said handle adapter to said position to be gripped by said said user in upright vacuum fashion.

21. The upright converter as defined by claim 10 including switch means adapted to be operated remote from an on-off switch on said portable vacuum, said switch means being operable to move said on-off switch of said portable vacuum between said on and off positions.

22. The upright converter as defined by claim 21 wherein said switch means includes a strap adapted to be secured about said portable vacuum to overlie said switch, said strap including a movable slide member engaging and being operable to move said switch between said on and off positions, said switch means also including a switch handle on said handle means at said gripping position to be moved between two positions, said switch handle being operably interconnected to move said slide member so as to move said switch between said on and off positions, whereby one of said two positions of said switch handle corresponds with said on position and the other of said two positions of said switch handle corresponds with said off position.

* * * * *